US007834835B2

(12) United States Patent
Kurokawa et al.

(10) Patent No.: US 7,834,835 B2
(45) Date of Patent: Nov. 16, 2010

(54) DISPLAY CONTROL DRIVE DEVICE AND DISPLAY SYSTEM

(75) Inventors: Yasuhito Kurokawa, Higashimurayama (JP); Kunihiko Tani, Kodaira (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 786 days.

(21) Appl. No.: 11/733,705

(22) Filed: Apr. 10, 2007

(65) Prior Publication Data

US 2007/0176880 A1 Aug. 2, 2007

Related U.S. Application Data

(62) Division of application No. 10/453,823, filed on Jun. 4, 2003, now Pat. No. 7,209,111.

(30) Foreign Application Priority Data

Jun. 27, 2002 (JP) ..... 2002-188022

(51) Int. Cl.
*G09G 3/36* (2006.01)

(52) U.S. Cl. ..... 345/87; 345/3.2; 345/204

(58) Field of Classification Search ..... 345/87–102, 345/204, 3.1–3.3
See application file for complete search history.

(56) References Cited

U.S. PATENT DOCUMENTS 5,406,308 A 4/1995 Shiki
5,959,691 A 9/1999 Koh
6,040,828 A 3/2000 Park
6,310,618 B1 10/2001 Zhang et al.
6,667,730 B1 12/2003 Taguchi et al.

FOREIGN PATENT DOCUMENTS

EP 1 069 457 A1 1/2001
JP 11-338438 10/1999

*Primary Examiner*—Kevin M Nguyen
*Assistant Examiner*—Kenneth B Lee, Jr.
(74) *Attorney, Agent, or Firm*—Miles & Stockbridge P.C.

(57) ABSTRACT

In a display control drive device that displays an image on a display device, a data transfer rate may vary depending on received image data because of a difference in an image size. Assuming that driving force with which a driver or an amplifier is driven is designed based on a maximum data transfer rate and the driver or amplifier is operated with the driving force, when the transfer rate is low, an unnecessary current is consumed. According to the present invention, a display control drive device sequentially reads display data from a display memory in which the display data is stored, produces three primary color image signals that are applied to pixel locations in a dot-matrix color display device, and transmits the signals through a common external output terminal in a time-sharing manner. Moreover, the display control drive device produces control signals to be applied to selection switching elements that are incorporated in the display device and that selectively apply an input image signal to any of three source lines. The display control drive device includes: a unit that determines one horizontal period on the basis of a clock received from outside synchronously with display data; and a signal production circuit that produces and transmits the control signals, which are applied to the selection switching elements, so that the control signals will have a pulse duration equivalent to a time calculated by trisecting one horizontal period.

1 Claim, 9 Drawing Sheets

DISPLAY CONTROL DRIVE DEVICE AND DISPLAY SYSTEM

CROSS-REFERENCE TO RELATED APPLICATION

This application is a division of application Ser. No. 10/453,823 filed Jun. 4, 2003 now U.S. Pat. No. 7,209,111.

BACKGROUND OF THE INVENTION

The present invention relates to a technology effectively adapted to a liquid crystal display control drive device that drives a liquid crystal panel so as to display data thereon and to an output method according to which the liquid crystal display control drive device realized with a semiconductor integrated circuit transmits a driving signal. The present invention relates to a technology effectively adapted to a liquid crystal display control drive device that drives a low-temperature polysilicon (LTPS) liquid crystal panel and to a liquid crystal display system including the liquid crystal display control drive device.

In recent years, a dot-matrix liquid crystal panel having a plurality of display pixel locations arrayed two-dimensionally in the form of a matrix has been generally adopted as a display device for portable electronic equipment including cellular mobile telephones and personal digital assistants. A display control device (liquid crystal controller) realized with a semiconductor integrated circuit and designed to control display on a liquid crystal panel and a driver that drives the liquid crystal panel, or a display control drive device (liquid crystal control driver) with a built-in driver is incorporated in the equipment.

The liquid crystal panel falls into a type made of an amorphous silicon and a type made of a low-temperature polysilicon and referred to as an low-temperature polysilicon (LTPS) liquid crystal panel. Since the liquid crystal panel includes a glass substrate, a manufacturing process does not include a high-temperature step. The LTPS liquid crystal panel is made of the polysilicon into which the amorphous silicon is denatured by performing laser annealing or the like. Compared with the employment of the amorphous silicon, the employment of the polysilicon has the merit that transistors can operate fast.

SUMMARY OF THE INVENTION

Many models of conventional liquid crystal panels to be adapted to portable electronic equipment are designed for display of monochrome still images. However, with the sophistication in the capability of the portable electronic equipment, the contents of display on a display section have diversified in recent years. The type of liquid crystal panel capable of displaying images in colors or displaying a motion picture has come to be procurable.

Incidentally, a color liquid crystal panel has pixel locations associated with three primary colors of red, green, and blue. A pixel electrode and a switching element formed with a thin-film transistor (TFT) and used to charge or discharge the pixel electrode are disposed at each pixel location. The sources of switching elements at pixel locations juxtaposed on the same row are connected on a common line (called a source line or a data line) over which an image signal is transmitted.

A conventional color liquid crystal panel has external terminals formed in association with source lines. The larger the panel, that is, the larger the number of display dots, the larger the number of external terminals. The liquid crystal panel is larger than a display control drive device realized with a semiconductor integrated circuit and used to drive the liquid crystal panel. Even if the number of external terminals increases with an increase in the size of the panel, a very serious problem does not occur. As far as the display control drive device realized with a semiconductor integrated circuit is concerned, the area of a chip and the volume of a package increase with an increase in the number of external terminals. For this reason, there is a demand for the smallest possible number of external terminals.

In the LTPS liquid crystal panel, the transistors incorporated can operate fast. Therefore, when a selector is included in the liquid crystal panel, three color pixel signals can be received through a common external terminal in a time-sharing manner. However, when the time-sharing driving method is adopted, the time allocated to charging of each pixel electrode diminishes to be a one-third of the time allocated when the time-sharing driving method is not adopted. Driving force with which a driver or an amplifier incorporated in a liquid crystal display control drive device is driven must be intensified. Power consumption of the driver or amplifier occupies a relatively large percentage of the power consumption of the entire chip realizing the liquid crystal display control drive device. When the driving force needed to drive the driver or amplifier is simply intensified, the stability of an output may be impaired.

More and more pieces of electronic equipment including cellular mobile telephones nowadays include a display system capable of displaying still images as well as a motion picture. Talking of the cellular mobile telephone, an image size or the like is different from model to model. A data transfer rate may therefore be varied depending on transmitted image data. Assuming that the driving force needed to drive the driver or amplifier is designed in consideration of a maximum data transfer rate, and the driver or amplifier is driven with the driving force, if the data transfer rate is low, an unnecessary current may be consumed.

Accordingly, an object of the present invention is to provide a display control drive device and a display system which even when a data transfer rate varies, can optimize a charging time, which is taken to charge a pixel electrode using a driver or an amplifier, according to an image data size or the like, and can thus minimize total power consumption.

Another object of the present invention is to provide a display control drive device and a display system which even when a frame frequency is changed based on an image data size or the like, can optimize a charging time, which is taken to charge a pixel electrode using a driver or an amplifier, according to the frame frequency, and can thus minimize total power consumption.

The above and other objects of the present invention and the novel features thereof will be apparent from the description of the specification and the appended drawings.

Typical constituent features of the present invention that will be disclosed in this application will be outlined below.

Specifically, a display control drive device sequentially reads display data from a display memory in which display data is stored, produces three primary-color image signals that are applied to pixel locations in a dot-matrix color display device, and transmits the image signals through a common external output terminal in a time-sharing manner. Moreover, the display control drive device produces and transmits control signals, which are applied to selection switching elements that are incorporated in the display device and that selectively apply an input image signal to any of three source lines. The display control drive device includes: a means that determines one horizontal period on the basis of a clock received from outside synchronously with display data; and a signal production circuit that produces and transmits the control signals, which are applied to the selection switching elements, so that the control signals will have a pulse duration equivalent to a time calculated by trisecting one horizontal period.

According to the foregoing means, each pixel location can be charged by taking the longest possible time that can be allocated. Therefore, one horizontal period is determined based on an image data size, a transfer rate, a characteristic of a panel, or the like. Moreover, a current flowing into a drive circuit that transmits an image signal based on which each pixel location is charged can be controlled to an optimal value. Eventually, the power consumption of the display control drive device can be minimized.

Moreover, another constituent feature of the present invention lies in a display control drive device which has the same components as those described above and in which a frame period that is a scanning period during which one screen image to be displayed on a display device is scanned is changed based on the size of an image to be displayed on the display device and the contents thereof. An output time taken to transmit the primary color signals is varied depending on the frame period. When the image size is small, the frame period is made longer than that when the image size is large. Moreover, the primary color signals are transmitted by taking a longer time. Consequently, the time taken to charge each pixel location can be increased to be as long as possible according to a frame frequency. A current flowing into a drive circuit that transmits an image signal can be controlled in order to further minimize the power consumption of the display control drive device.

DESCRIPTION OF THE PREFERRED EMBODIMENTS

Figure 1:
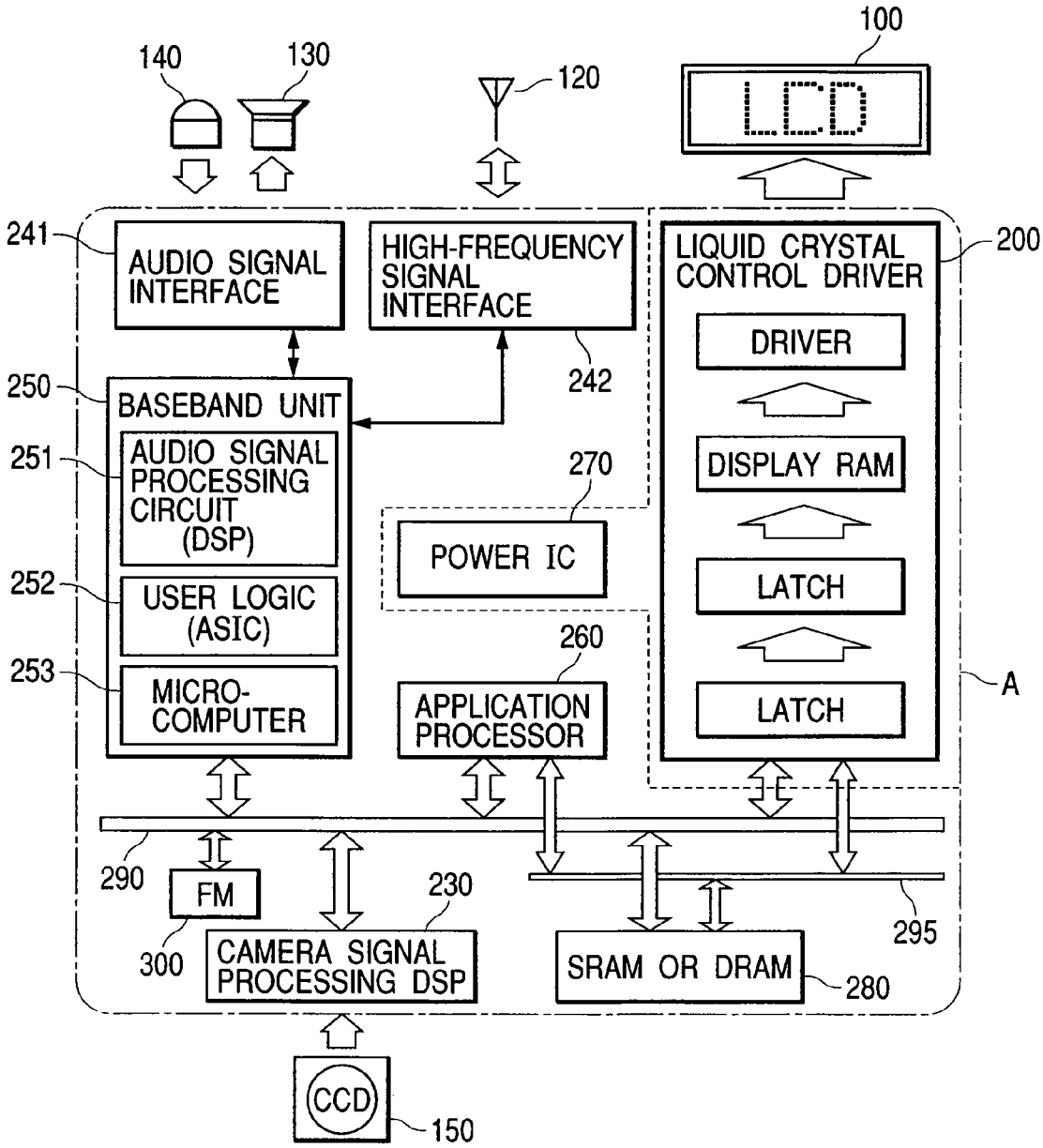
FIG. 1 is a block diagram showing the overall configuration of a cellular mobile telephone having a liquid crystal control driver in which the present invention is implemented.

Referring to the drawings, preferred embodiments of the present invention will be described below.

FIG. 1 is a block diagram showing the overall configuration of a cellular mobile telephone including a liquid crystal display control drive device (hereinafter, a liquid crystal control driver) in accordance with the present invention.

The cellular mobile telephone to which the present embodiment is adapted consists mainly of: a liquid crystal panel 100 serving as a display section; a transmitting/receiving antenna 120; a loudspeaker 130 for radiating sounds; a microphone 140 for receiving sounds; a solid-state imaging device 150 realized with a charge-coupled device (CCD) or a CMOS sensor and the like; an image signal processing circuit 230 including a digital signal processor (DSP) that processes an image signal received from the solid-state imaging device 150; a liquid crystal control driver 200 that is a liquid crystal display control drive device in accordance with the present invention; an audio signal interface 241 through which an audio signal is transmitted or received to or from the loudspeaker 130 or microphone 140; a high-frequency signal interface 242 through which a high-frequency signal is transmitted or received to or from the antenna 120; a baseband unit 250 that processes an audio signal and transmitted and received signals; a motion picture processing circuit (hereinafter, called an application processor) 260 realized with a microprocessor or the like that has the capabilities to processes a motion picture according to a MPEG (stands for moving picture experts group) standard, to effect multimedia, to regulate a resolution, and to process Java data quickly; a power IC 270; and a memory 280 in which data is stored. The application processor 260 has the capability to process, in addition to an image signal received from the solid-state imaging device 150, motion picture data that is received from other cellular mobile telephone via the high-frequency interface 242.

ICs and parts shown being enclosed with a dot-dash line A are mounted on one circuit board such as a printed-circuit board. The liquid crystal control driver 200 used to be mounted on the same circuit board. Recently, the liquid crystal control driver 200 and power IC 270 are often mounted on a glass included in the liquid crystal panel 100 in a chip-on-glass (COG) manner for obtaining a miniaturized and thinned mobile terminal of cellular mobile telephones. A system bus 290 and a display data bus 295 are formed. The image signal processing circuit 230, liquid crystal control driver 200, baseband unit 250, application processor 260, and memory 280 are interconnected over the system bus 290. The liquid crystal control driver 200, application processor 260, and memory 280 are interconnected over the display data bus 295.

The baseband unit 250 consists mainly of: an audio signal processing circuit 251 that is realized with, for example, a digital signal processor (DSP) and processes an audio signal; an application-specific integrated circuit (ASIC) 252 that provides a customization facility (user logic); and a microprocessor or microcomputer 253 serving as a data processing unit that controls the entire system.

The liquid crystal panel 100 is a dot-matrix color low-temperature polysilicon (LTPS) thin-film transistor (TFT) liquid crystal panel having display pixel locations arrayed in the form of a matrix. One pixel is composed of three dots of red, blue, and green. Moreover, a pixel electrode, and a switching element realized with a TFT and used to charge or discharge the pixel electrode are disposed at each pixel location. The sources of switching elements at pixel locations juxtaposed on the same row are connected on a common line over which a pixel selection level is transmitted. The gates of the switching elements juxtaposed on the same row connected on a common line (called a gate line) over which a pixel selection level is transmitted.

A control program and control data according to which the entire cellular mobile telephone system as well as display is controlled is stored in a flash memory 300 that can be erased in units of a predetermined number of blocks at a time. The memory 280 is used as a frame buffer in which image data having undergone various kinds of image processing is preserved, and realized normally with an SRAM or SDRAM.

Figure 2:
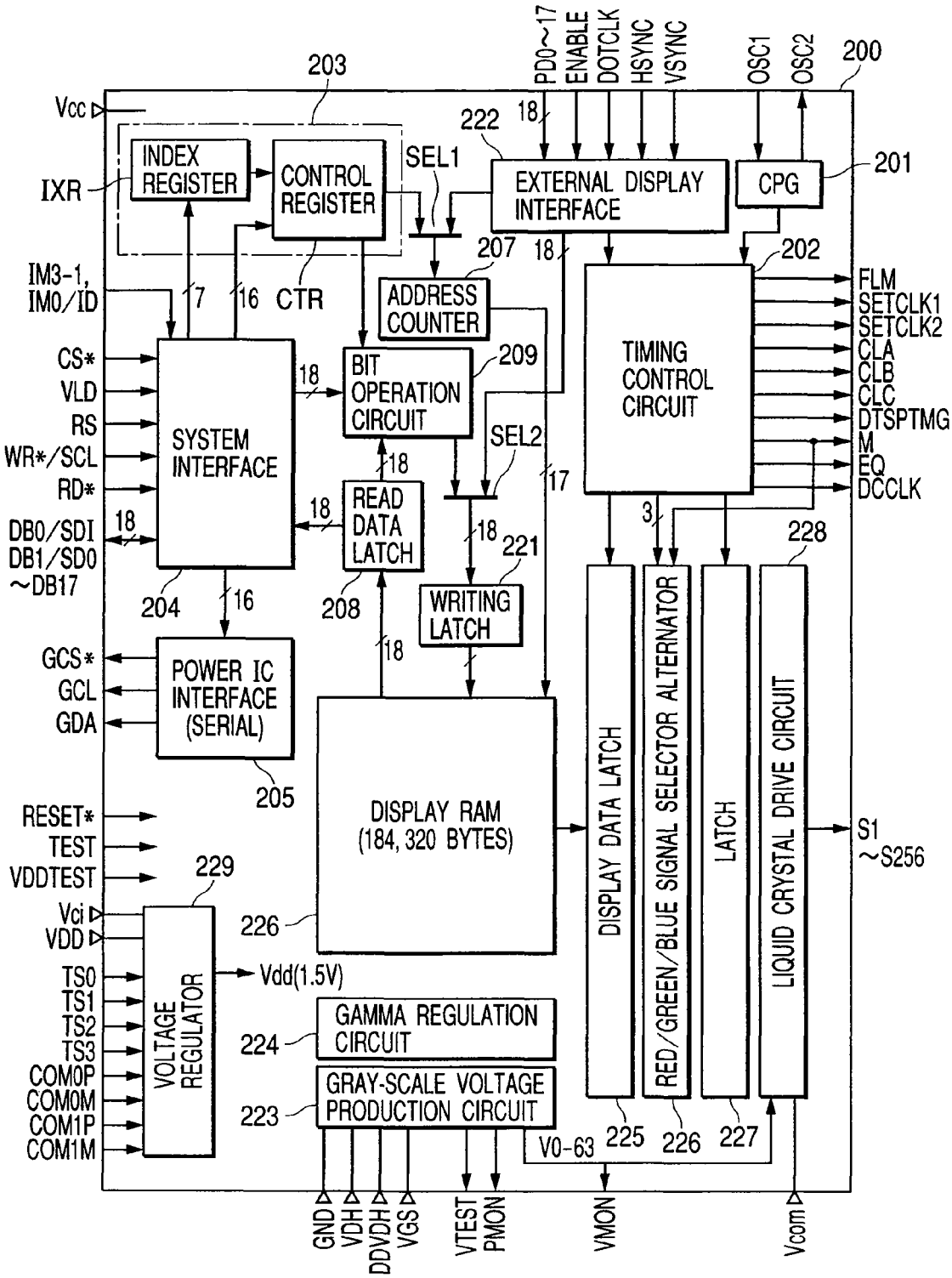
FIG. 2 is a block diagram showing an example of the configuration of a liquid crystal control driver in accordance with an embodiment.

FIG. 2 is a block diagram showing an embodiment of the liquid crystal control driver 200 shown in FIG. 1.

The liquid crystal control driver 200 of the present embodiment includes: a pulse generator 201 that generates a reference clock pulse, which is used within a chip, on the basis of an oscillating signal received from outside or an oscillating signal received from a transducer via an external terminal; a timing control circuit 202 that generates a timing control signal, which is used within the chip, on the basis of the clock pulse; a control unit 203 that controls all the components on the chip according to a command received from the external microcomputer 253; a system interface 204 via which a command or data such as still image data is transferred to or from the microcomputer 253 over the system bus 290; and a power interface 205 via which a control signal GCS, a clock pulse GCL, a command GDA, or the like is applied to the external power IC 270.

Figure 3:
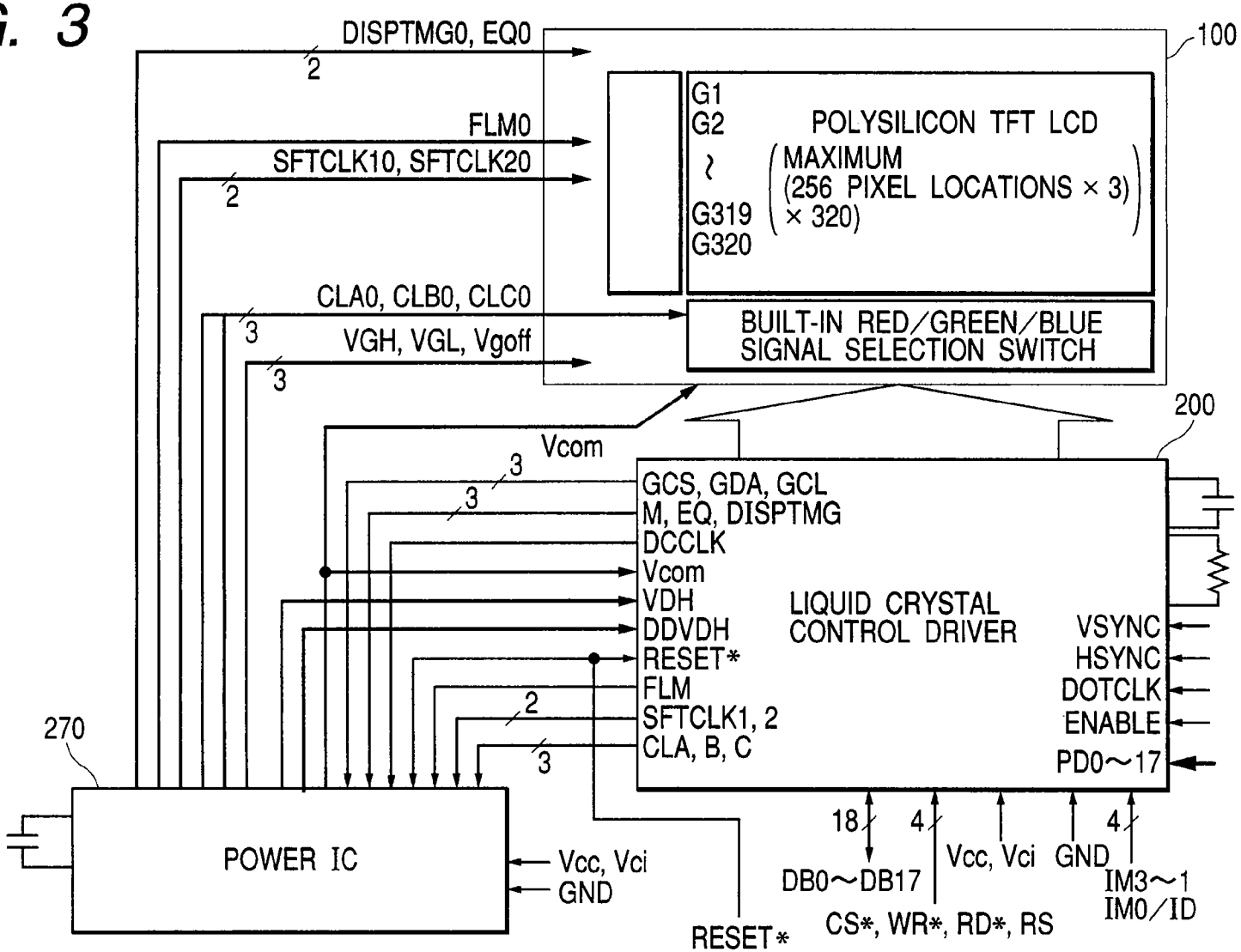
FIG. 3 shows a system configuration presenting the relationship among connections linking a liquid crystal panel, a liquid crystal control driver, and a power IC.

The power IC 270 has the capability to produce a voltage needed to drive a liquid crystal, and the capability to shift the level of clocks SFTCLK1 and SFTCLK2, clocks CLA to CLC, a frame synchronizing (sync) signal FLM, and display control signals DISPTMG and EQ which are transmitted from the timing control circuit 202. Incidentally, reference numerals denoting timing signals whose levels have been shifted by the power IC 270 have a trailing alphabet O, such as, SFTCLK1O, SFTCLK2O, EGO, FLMO, CLAO to CLCO, and DISPTMGO. The liquid crystal control driver 200 of the present embodiment is used in combination with the power IC 270 having the foregoing capabilities. FIG. 3 shows the relationship among the liquid crystal panel 100, liquid crystal control driver 200, and power IC 270.

Moreover, the liquid crystal control driver 200 of the present embodiment includes: a display random access memory (RAM) 206 serving as a display memory in which display data is stored in the form of a bit map; an address counter 207 that produces an address in the display RAM 206; a read data latch 208 that holds data read from the display RAM 206; a bit operation circuit 209 that includes an arithmetic logic means which performs arithmetic logic operations so as to wartermark or superimpose an image on the basis of data read by the read data latch 28, that is, the contents of existing display and new display data sent from the microcomputer 253, and a bit shifting means which enables scrolling, and that manipulates bits of data written by the microcomputer 253 or data read from the display RAM 206; a writing latch 221 that fetches data whose bits have been manipulated, and writes the data in the display RAM 206; and an external display interface 222 via which motion picture data and horizontal and vertical sync signals HSYNC and VSYNC are received from the application processor 260 over the display data bus 295. Motion picture data received from the application processor 260 is transferred synchronously with a dot clock pulse DOTCLK. The external display interface 222 can receive still image data sent from the microcomputer 253.

Furthermore, the liquid crystal control driver 200 of the present embodiment includes: a gray-scale voltage production circuit 223 that produces a gray-scale voltage needed to produce a signal, of which waveform is suitable for color display or gray-scale display, on the basis of voltages DDVD, VDH, and VGS received from the external power IC 270; a gamma regulation circuit 224 that determines a gray-scale voltage according to the gamma characteristic of the liquid crystal panel 100; a display data latch 225 that holds display data read from the display RAM 206 for the purpose of display on the display panel; a selector alternator 226 that selects red, green, or blue data from display data read into the display data latch 225, and converts the read data into an alternating quantity that helps prevent deterioration of a liquid crystal; a latch 227 that holds converted data; a liquid crystal drive circuit 228 that selects a voltage proportional to display data from among the gray-scale voltages sent from the gray-scale voltage production circuit 223, and transfers any of voltages S1 to S256 which is applied to one of source lines included in the liquid crystal panel 100; and a voltage regulator 229 that steps down a voltage Vci, which is 3.3 V or 2.5 V and received from outside, so as to produce a supply voltage Vdd of 1.5 V to be applied to the internal circuits. Trimming signals TS0 to TS3, and COM0P to COM1M are used to regulate a voltage produced by the voltage regulator 229. Referring to FIG. 2, reference numerals SEL1 and SEL2 denote data selectors.

A gate driver that is realized with a polysilicon TFT and that sequentially drives gate lines, on each of which the gates of switching elements at pixel locations juxtaposed on the same row are connected, up to a selection level, and a shift register that designates a gate line to be driven to the selection level are included in the liquid crystal panel 100. The inclusion of the gate driver and shift register is not limitative. The timing control circuit 202 applies a frame sync signal FLM or two clock pulses SFTCLK1 and SFTCLK2 to the liquid crystal panel. The clock pulses SFTCLK1 and SFTCLK2 are 180° out of phase or do not overlap and are used to cause the shift register for designating a gate line to shift a data bit.

Moreover, in the liquid crystal control driver 200 of the present embodiment, the liquid crystal drive circuit 228 transmits the driving signals, with which pixel locations associated with red, green, and blue are driven, through a common terminal in a time-sharing manner according to the structure of the liquid crystal panel 100. Moreover, the timing control circuit 202 produces and transmits three timing clocks CLA, CLB, and CLC that indicate which color pixel location driving signal is transmitted to the liquid crystal panel 100 or that indicate a period during which a color pixel location driving signal is being transmitted. Furthermore, the timing control circuit 202 produces and transmits a display timing signal DISPTMG that designates a line to be displayed on the liquid crystal panel 100.

The control unit 203 includes: a control register CTR that is used to control the operating state of the entire chip such as the operation mode of the liquid crystal control driver 100; and an index register IXR that is used to designate a plurality of command codes and a command to be executed for the control unit in advance. When the external microcomputer 253 writes data in the index register IXR so as to designate a command to be executed, the control unit 203 in turn produces a control signal according to the designated command.

Under the control of the thus configured control unit 203, the liquid crystal control driver 100 displays an image on the liquid crystal panel 100 on the basis of a command sent from the microcomputer 253 and relevant data. At this time, rendering is performed in order to sequentially write display data in the display RAM 206. Moreover, reading is performed in order to periodically read display data from the display RAM 206. Thus, a signal to be applied to each source line included in the liquid crystal panel 100 is produced and transmitted.

The system interface 204 is used to transfer required signals including register setting data and display data to or from the microcomputer 253 during rendering during which display data is written in the display RAM 206. An 80-series interface enabling selection through terminals IM3-1 and IM0/ID may be adopted as the system interface 204. In this case, control signal lines and data signal lines are laid between the microcomputer 253 and system interface 204. A chip select signal CS* with which a chip to which data is transmitted can be selected, a register select signal RS with which a register in which data is saved can be selected, and writing and reading control signals WR* and RD* are transmitted over the control signal lines. Data signals DB0 to DB17 of 18 bits long including register setting data and display data are transferred over the data signal lines.

Among the data signal lines DB0 to DB17, the data signal lines DB0 and DB1 also serve as serial data communication lines. A signal SCL applied to a terminal that is shared with a reading/writing control signal WR* is a serial clock pulse used to receive or transmit serial data. Incidentally, the asterisk * appended to a reference numeral signifies that a signal denoted by the reference numeral is active low. When receiving or transmitting serial data is adopted, the data signal lines DB2 to DB18 become unnecessary. Consequently, the width of the system bus 290 formed on the circuit board can be decreased.

Figure 4:
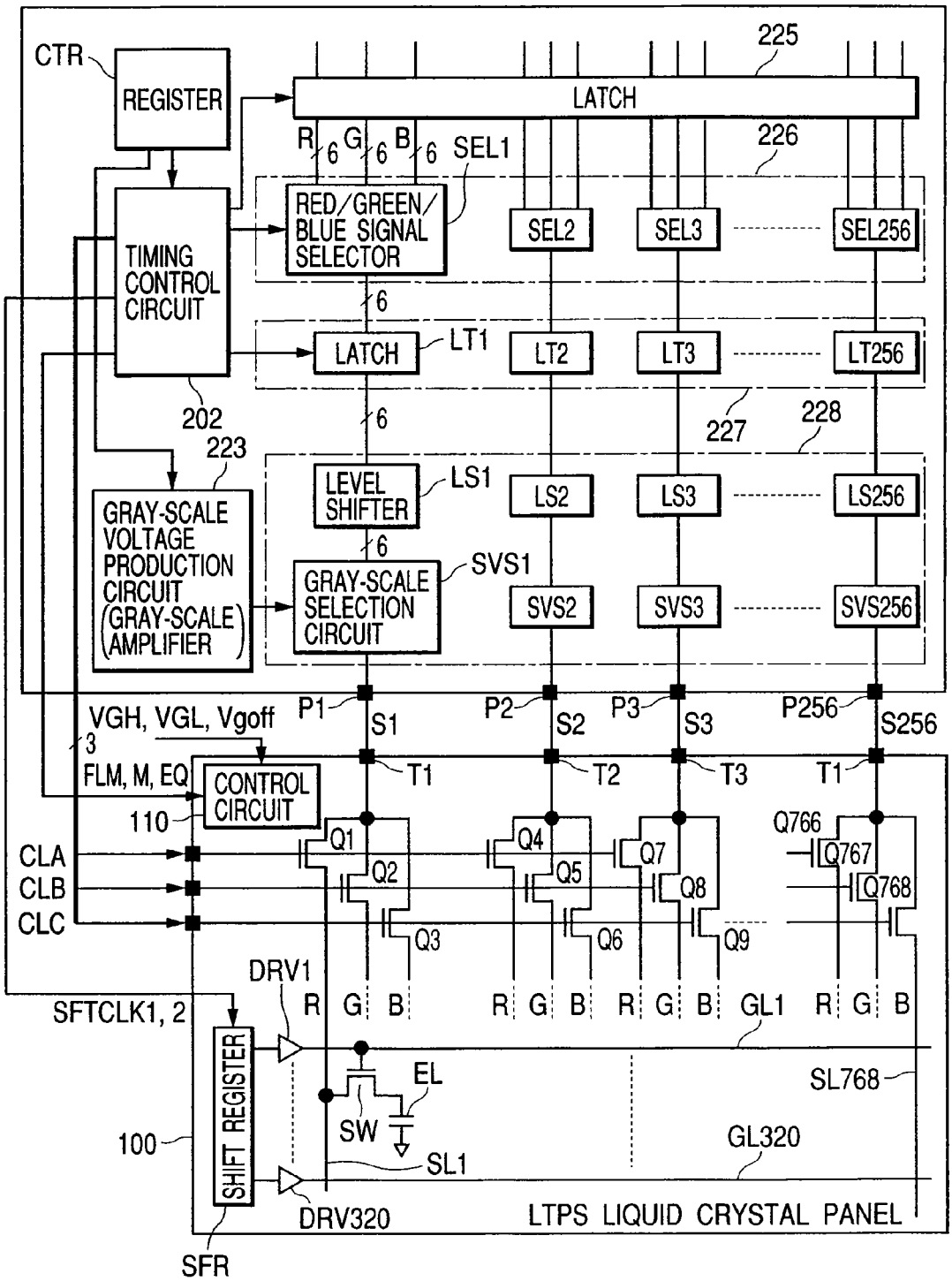
FIG. 4 is a block diagram showing an example of the configurations of a liquid crystal drive circuit incorporated in the liquid crystal control driver and of a circuit incorporated in the liquid crystal panel.

FIG. 4 shows an example of the configurations of the liquid crystal drive circuit 228 and a circuit incorporated in the liquid crystal panel. Referring to FIG. 4, the same reference numerals are assigned to circuits identical to those shown in FIG. 2. Reiteration is omitted. In FIG. 4, the power IC 270 is not shown. Therefore, signals produced by the timing control circuit 202 are shown to be transmitted directly to the liquid crystal panel 100. If the liquid crystal control driver 200 has the capability of the power IC 270, the connection shown in FIG. 4 is feasible.

In the present embodiment, display data read from the display RAM 206 and representing one pixel is 18 bits long because red, green, and blue data items constituting one bit are each 6 bits long. In the display data latch 225, 18-bit data is held relative to each of the source lines incorporated in the liquid crystal panel. Any of the 6-bit red, green, and blue data items constituting the 18-bit display data is selected by any of unit selectors SEL1 to SEL256 included in the selector alternator 226. The selected data is latched by any of unit latches LT1 to LT256 constituting the latch 227. Moreover, red, green, and blue changeover signals CLA, CLB, and CLC associated with a signal based on which any of the unit selectors SEL1 to SEL256 is selected are transmitted to the liquid crystal panel 100.

The liquid crystal drive circuit 228 is composed of level shift circuits LS1 to LS256 and gray-scale voltage selection circuits SVS1 to SVS256. A data signal latched by any of the unit latches LT1 to LT256 has the level thereof shifted by an associated one of the level shift circuits LS1 to LS256. Based on the resultant signal, an associated one of the gray-scale voltage selection circuits SVS1 to SVS256 selects a voltage proportional to display data from among voltages produced by the gray-scale voltage production circuit 223, and transmits the selected voltage to the liquid crystal panel 100 through an associated one of output terminals P1 to P256.

The liquid crystal panel 100 is not limited to any particular one. In the present embodiment, red, green, and blue pixel locations are repeatedly and orderly juxtaposed line (row) by line. Pixel locations associated with the same color are lined in the direction of a column. Each pixel location is composed of a switching element SW realized with a TFT and a pixel electrode EL. Charge proportional to an image signal is accumulated in a capacitor lying between each pixel electrode and a common electrode opposed to the pixel electrode with a liquid crystal between them.

Referring to FIG. 4, reference numerals SL1 to SL320 denote source lines on each of which the sources of switching elements at pixel locations juxtaposed on the same line are connected in common. Reference numerals GL1 to GL320 denote gate lines on each of which the gates of the switching elements at the pixel locations juxtaposed on the same line are connected in common. Each gate line is set to a selection level once a frame period. The switching elements connected on a gate line set to the selection level are turned on. The other switching elements are all turned off. Moreover, reference numerals SL1 to SL768 denote source lines on each of which the sources of switching elements at pixel locations lined on the same column are connected in common. An image signal is applied to the pixel locations over each of the source lines. Consequently, the pixel electrodes at the pixel locations are charged with charge proportional to the image signal.

The liquid crystal panel 100 employed in the present embodiment has segment terminals T1 to T256 that number a one-third of the number of source lines SL1 to SL768. Groups of three source lines SL1 to SL3, SL4 to SL6, etc., and SL766 to SL768 which are associated with the columns of red, green, and blue pixel locations are routed to the segment terminals T1 to T256 via sets of three selection switching elements Q1 to Q3, Q4 to Q6, etc., and Q766 to Q768 respectively. One source line belonging to each of the groups of three source lines SL1 to SL3, SL4 to SL6, etc., and SL766 to SL768 is selected. The sets of three selection switching elements Q1 to Q3, Q4 to Q6, etc., and Q766 to Q768 are turned on or off with the red, green, and blue changeover signals CLA, CLB, and CLC sent from the timing control circuit 202.

Moreover, the liquid crystal panel 100 employed in the present embodiment has gate drivers DRV1 to DRV320 that are associated with the gate lines GL1 to GL320 and drive the associated gate lines GL1 to GL320. A shift register SFR is disposed in a direction perpendicular to the direction in which the gate lines GL1 to GL320 are extended. Furthermore, the liquid crystal panel 100 has a control circuit 110 that produces a control signal, with which the internal circuits of the panel are controlled, on the basis of control signals FLM, M, and EQ sent from the timing control circuit 202 and control voltages VGH, VGL, and Vgoff.

Outputs of flip-flops in respective stages constituting the shift register SFR are applied to the input terminals of the gate drivers DRV1 to DRV320. The shift register SFR circulates a bit 1 once a frame period by shifting the bit 1 from one flip-flop to an adjoining flip-flop synchronously with the shift clock SFTCLK1 or SFTCLK2 sent from the timing control circuit 202. Thus, each gate line is set to the selection level once a frame period.

Figure 5A:
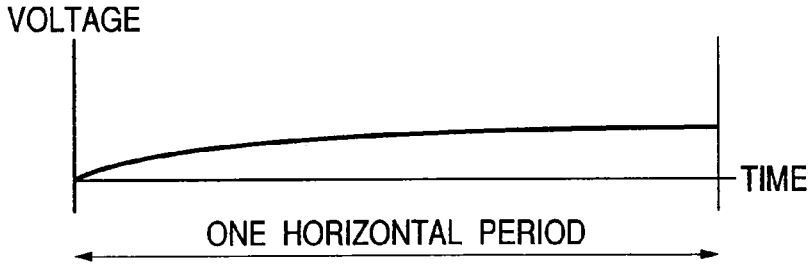
FIG. 5A, FIG. 5B, and FIG. 5C show waveforms indicating that an action of charging a pixel location is different between when the present invention is not implemented and when the present invention is implemented.
Figure 5B:
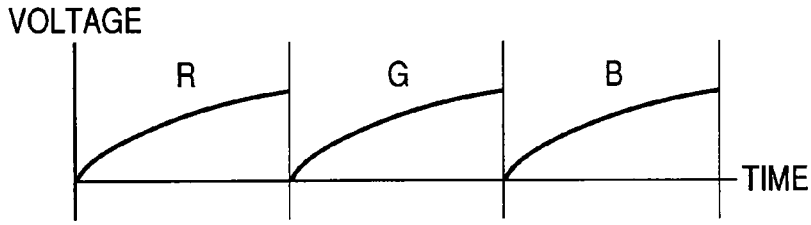
Figure 5C:
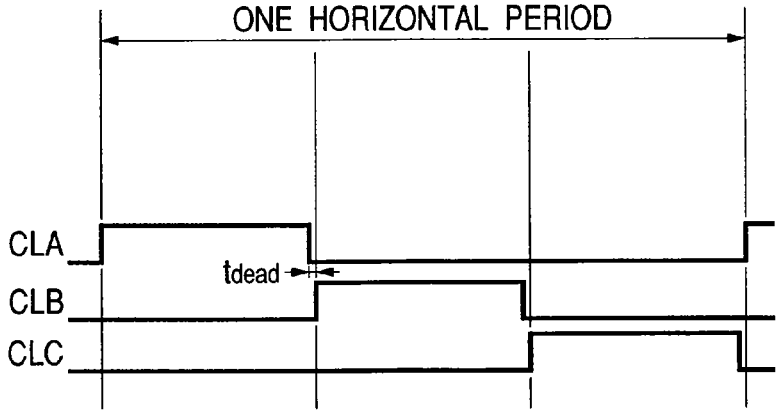

Moreover, during one horizontal period during which one gate line is retained at the selection level, the red, green, and blue changeover signals CLA, CLB, and CLC are, as shown in FIG. 5C, orderly driven high and remain high during a one-third of the horizontal period. An image signal sent from the liquid crystal display control driver 200 is placed on one source line selected from a set of three source lines by the switching elements Q1 to Q768. The image signal is synchronous with any of the changeover signals CLA, CLB, and CLC. Consequently, red, green, and blue image signals are transmitted from the liquid crystal display control driver 200 in a time-sharing manner during one horizontal period.

FIG. 5A signifies that a pixel location is charged by taking one horizontal period. Instead, in a liquid crystal panel having segment terminals in one-to-one association with source lines, red, green, and blue pixel locations are, as seen from FIG. 5B, charged orderly by taking a one-third of one horizontal period. In order to realize the time-sharing charging, an output amplifier incorporated in the gray-scale voltage production circuit 223 included in the liquid crystal control driver of the present embodiment is designed to exert greater driving force than it does when a pixel electrode is, as seen from FIG. 5A, charged by taking one horizontal period.

Moreover, the output amplifier incorporated in the gray-scale voltage production circuit 223 has a plurality of current sources from which a driving current flows. The number of current sources that are turned on is controlled based on required driving force indicated with a value set in the control register CTR. This is because the capacitance of a parasitic capacitor of a source line or an electrode capacitance of a pixel electrode differs with a liquid crystal panel employed. By changing the value set in the register, a driving current flowing out of the output amplifier incorporated in the gray-scale voltage production circuit 223 is varied depending on the capacitance. Thus, the liquid crystal control driver can be adapted to a plurality of liquid crystal panels that are different from one another in terms of the capacitance.

The liquid crystal panel 100 employed in the present embodiment has been described on the assumption that pixel locations associated with the same color of red, green, or blue are lined on the same column. The present invention can be adapted to a liquid crystal panel in which red, green, and blue pixel locations are orderly lined in the direction of columns. In this case, the order of driving a selection signal to the selection level is changed from the sequence of the changeover signals CLA, CLB, and CLC to the sequence of the changeover signals CLB, CLC, and CLA or the sequence of the changeover signals CLC, CLA, and CLB. Consequently, appropriate display can be achieved without a change in the order of transferring red, green, and blue image signals. Instead of changing the sequence of the red, green, and blue changeover signals CLA, CLB, and CLC, the order of transferring the red, green, and blue image signals from the liquid crystal control driver 200 to the liquid crystal panel may be changed to the sequence of the green, blue, and red image signals or the sequence of the blue, red, and green image signals. Otherwise, a scrambler circuit that changes the transmission path of a signal may be interposed between the input terminals of the liquid crystal panel 100 through which the red, green, and blue changeover signals CLA, CLB, and CLC are received and the gate terminals of the selection switching elements Q1 to Q768. Thus, the three selection switching elements belonging to each of the groups of the selection switching elements Q1 to Q768, which transfer the red, green, and blue changeover signals CLA, CLB, and CLC respectively, may be switched according to a selected line.

Incidentally, in the cellular mobile telephone which is shown in FIG. 1 and to which the present embodiment is adapted, a transfer rate of image data that is sent from the application processor 260 to the liquid crystal control driver 200 may vary depending on an image size. The transfer rate is controlled so that image data representing one line will be transferred during one horizontal period, whereby continuous data transfer is enabled. However, in this case, the liquid crystal control driver 200 that receives the image data must extend control so as to change the timings of the red, green, and blue changeover signals CLA, CLB, and CLC according to the transfer rate of image data.

In the liquid crystal control driver 200 of the present embodiment, the timing control circuit 202 is designed to extend the above control. In other words, the timing control circuit 202 is designed so that it can change the timings of the red, green, and blue changeover signals CLA, CLB, and CLC according to the transfer rate of image data. Thus, continuous data transfer is enabled by changing the transfer rate of image data, which the application processor 260 transfers to the liquid crystal display control drive device 200, according to an image size.

Next, a concrete example of the timing control circuit 202 that can extend control so as to change the timings of the red, green, and blue changeover signals CLA, CLB, and CLC according to the transfer rate of image data will be described in conjunction with FIG. 6.

The timing control circuit 202 included in the present embodiment includes, for example, a selector SEL3 that selects a clock or an equivalent facility. This is intended to enable the timing control circuit 202 to act based on an oscillating clock OSC produced by an internal oscillatory circuit 201 or to act based on a dot clock DOTCLK synchronous with image data applied to the display interface 222. Whichever of the clocks the selector SEL3 will select is controlled based on the setting of a mode register MDR incorporated in the control register CTR.

The timing control circuit 202 includes: a variable-frequency division circuit 2021 that produces an integral submultiple of the frequency of a clock selected by the selector SEL3; a counter 2022 that counts the number of clock pulses of the resultant clock BCLK; a red/green/blue changeover signal production circuit 2023 that adjusts the pulse duration of the red, green, and blue changeover signals CLA, CLB, and CLC, which determines a charging time taken to charge a pixel electrode, adjusts the rising or dropping timings of the red, green, and blue changeover signals CLA, CLB, and CLC, and transmits the resultant signals; a shift clock production circuit 2024 that produces shift clocks SFTCLK1 and SFTCLK2 based on which the shift register SFR changes the gate drivers in the liquid crystal panel; and a frame period signal production circuit 2025 that produces a signal FLM indicating a frame period on the basis of a vertical sync signal VSYNC. The variable-frequency division circuit 2021 and counter 2022 are included so that the minimum length of a dead time tdead (see FIG. 5) can be determined. The dead time tdead is inserted for fear the high-level periods of the red, green, and blue changeover signals CLA, CLB, and CLC will not overlap.

Moreover, the control register CTR includes: a frequency division ratio setting register DRR in which a frequency division ratio based on which the variable-frequency division circuit 2021 produces a signal whose frequency is an integral submultiple of the frequency of a clock is set; a one-horizontal period clock pulse count setting register CNR in which the number of clock pulses that will be counted by the counter 2022 during one horizontal period is set; a CL rising position setting register RTR in which positions in the red/green/blue changeover signal production circuit 2023 at which the changeover signals rise are set; a charging time setting register TMR in which the pulse duration of changeover signals, that is, a charging time taken to charge a pixel electrode is set; a shift control register SCR used to control the action of the shift clock production circuit 2024; and a frame period setting register FSR in which the cycle of a frame period signal FLM produced by the frame period signal production circuit 2025 is set.

Figure 6:
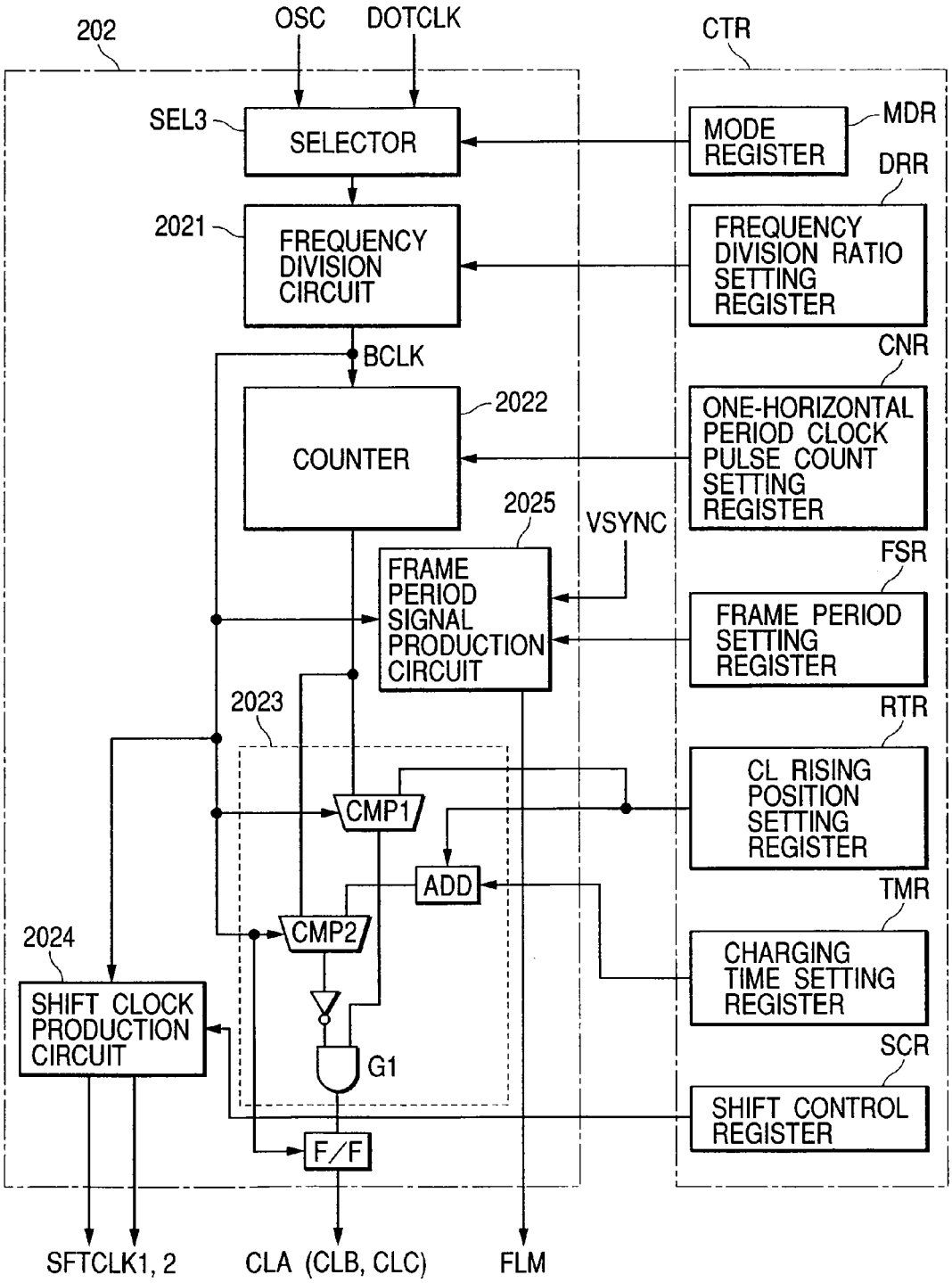
FIG. 6 is a block diagram showing an example of the configuration of a timing control circuit incorporated in the liquid crystal control driver of the embodiment.

The registers shown in FIG. 6 do not correspond to all the registers included in the control register CTR. There are other registers included in the control register CTR. In the CL rising position setting register RTR, three values are set based on the changeover signals CLA, CLB, and CLC to be produced in the present embodiment, and compared with one another. Since the changeover signals CLA, CLB, and CLC have the same pulse duration, one value is set in the charging time setting register TMR.

The red/green/blue changeover signal production circuit 2023 includes: a first comparison circuit CMP1 that compares the value set in the CL rising position setting register RTR with a value counted by the counter 2022 so as to determine the rising timing; an addition circuit ADD that summates the value set in the CL rising position setting register RTR and the value set in the charging time setting register TMR; a second comparison circuit CMP2 that compares the result of summation with the count value of the counter 2022 so as to determine the dropping timing; an inverter INV that inverts an output of the second comparison circuit CMP2; an AND gate G1 that calculates the AND of an agreement detection signal produced by the first comparison circuit CMP1 and a signal that is the reverse of an agreement detection signal produced by the second comparison circuit CMP2 which is produced by the inverter INV; and a flip-flop FF that holds an output signal of the AND gate G1.

The first comparison circuit CMP1 and second comparison circuit CMP2 perform comparison synchronously with a clock BCLK produced by the variable-frequency division circuit 2021. An arithmetic circuit may be substituted for the comparison circuits. In this case, the arithmetic circuit detects agreement by checking if the result of subtraction between two values to be compared with each other is 0. Moreover, instead of operating the first comparison circuit CMP1 and second comparison circuit CMP2 synchronously with the clock BCLK, the flip-flop FF in the succeeding stage of the AND gate G1 may be designed to perform latch synchronously with the clock BCLK.

The display screen FLD of a liquid crystal panel employed has a size that is defined with the number of pixels as 320 by 80 or with the number of dots as 320 by 240. Now, the liquid crystal panel shall be driven with a frame frequency set to 90 Hz and 32 lines left usable during a vertical-blanking interval. A description will be made of how the timing control circuit 202 sets a value in the frequency division ratio setting register DRR, one-horizontal period clock pulse count setting register CNR, and charging time setting register TMR respectively. When the frame frequency is set to 90 Hz, one horizontal period 1H is calculated as 1H=1÷{90 [Hz]×(320+32) [lines]}=31.57 [μs].

Figure 7A:
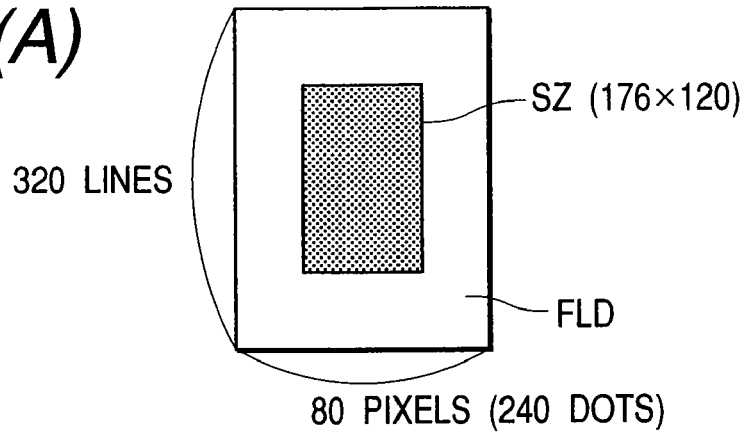
FIG. 7A, FIG. 7B, and FIG. 7C show the relationship between a display screen of a system including the liquid crystal control driver of the embodiment and image data.

When the image size SZ is expressed with the number of dots as 176 by 120 as shown in FIG. 7A, image data is transferred synchronously with the dot clock DOTCLK having a cycle of 0.263 (=31.57÷120) [μs]. In this case, for example, 4 is set as a frequency division ratio in the frequency division ratio setting register DRR; 30 is set as the number of clock pulses in the one-horizontal period clock pulse count setting register CNR; and 10 is set in the charging time setting register TMR. The charging time tc taken to charge each of red, green, and blue pixel electrodes is calculated as tc=0.263 [μs]×4 [frequency division ratio]×10 [clocks]=10.52 [μs].

Figure 7B:
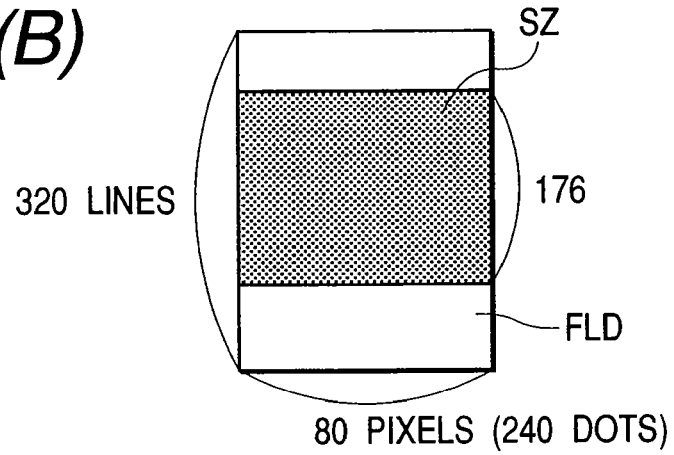

When the image size SZ is expressed with the number of dots as 176 by 240 as shown in FIG. 7B, image data is transferred synchronously with the dot clock DOTCLK having a cycle of 0.1315 (=31.57÷240) [μs]. In this case, for example, 8 is set as a frequency division ratio in the frequency division ratio setting register DRR; 30 is set as the number of clock pulses in the one-horizontal period clock count setting register CNR; and 10 is set in the charging time setting register TMR. The charging time tc taken to charge each of red, green, and blue pixel electrodes is calculated as tc=0.1315 [μs]×8 [frequency division ratio]×10 [clocks]=10.52 [μs].

Figure 7C:
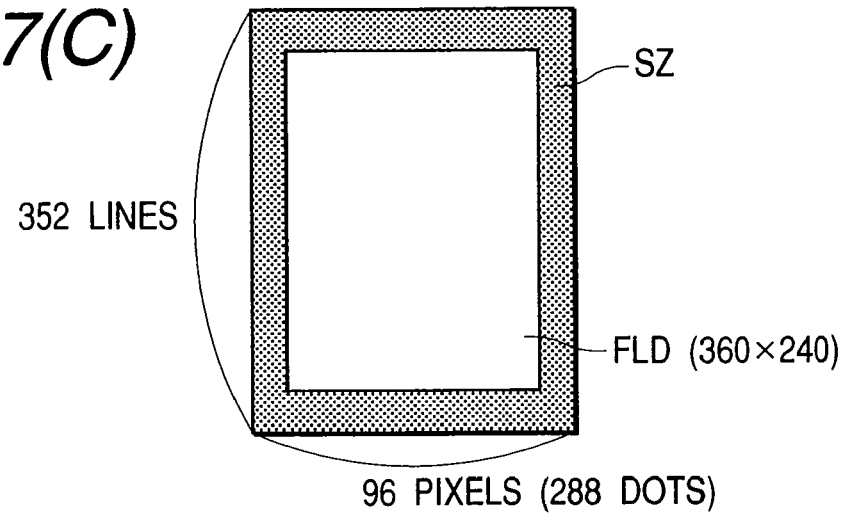
Figure 8:
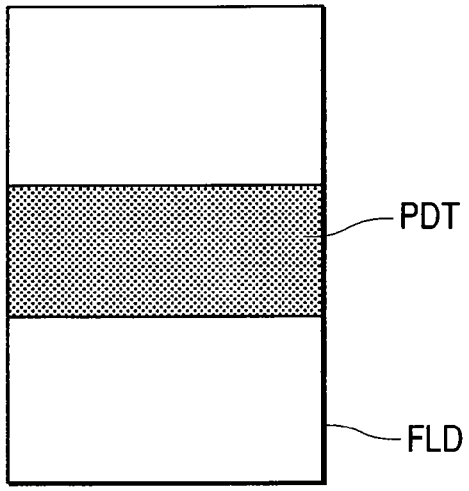
FIG. 8 shows the relationship between a display screen of a system that includes a liquid crystal control driver in accordance with a second embodiment and that permits partial display and a display area.

When the image size SZ is expressed with the number of pixels as 352 by 120 (352 by 288 dots) as shown in FIG. 7C, image data is transferred synchronously with the dot clock DOTCLK having a cycle of 0.1096 (=31.57÷288) [μs]. In this case, for example, 8 is set as a frequency division ratio in the frequency division ratio setting register DRR; 36 is set as the number of clocks in the one-horizontal period clock pulse count setting register CNR; and 12 is set in the charging time setting register TMR. Consequently, the charging time tc taken to charge each of red, green, and blue pixel electrodes is calculated as tc=0.1096 [μs]×8 [frequency division ratio]×12 [clocks]=10.52 [μs].

As mentioned above, according to the timing control circuit included in the present embodiment, even when image data having a different data size is transferred synchronously with a dot clock DOTCLK having a different cycle, as long as a frame period remains constant, a charging time taken to charge a pixel electrode can be set to the same time approximate to a maximum time (a one-third of one horizontal period). In the present embodiment, the charging time setting register TMR is included in order to control the high-level periods of the red, green, and blue changeover signals CLA, CLB, and CLC. Alternatively, a circuit for calculating a one-third of a value set in the one-horizontal period clock pulse count setting register CNR may be included so that the calculated value will be transmitted to the red/green/blue changeover signal production circuit 23. Thus, the red, green, and blue changeover signals CLA, CLB, and CLC may be produced.

Next, a second embodiment of the present invention will be described below. The present embodiment is such that an output amplifier incorporated in a gray-scale voltage production circuit 223 includes a plurality of current sources. Therefore, driving force values can be switched. In a cellular mobile telephone, in standby mode, an image is not displayed on an entire display screen but displayed in an area PDT that is part of the display screen FLD (this display mode shall be referred to as partial display). Control is thus extended in order to minimize power consumption.

In the second embodiment, the power consumption is further minimized by reducing a bias current that flows into an output amplifier incorporated in the gray-scale voltage production circuit 223 during the partial display. Moreover, during the partial display, the pulse duration of red, green, and blue changeover signals CLA, CLB, and CLC is doubled by thus determining the setting of a charging time setting register TMR. On the other hand, a gate selection time during which a gate is selected by a gate driver must also be extended. Therefore, the setting of a shift control register SCR is modified so that the cycle of a clock to be produced by a shift clock production circuit 2024 will be doubled.

To be more specific, when a frame frequency for full screen display is 90 Hz, the frame frequency is, for example, changed to a half, that is, 45 Hz for partial display. Accordingly, the pulse duration of the red, green, and blue changeover control signals CLA, CLB, and CLC to be transmitted to a liquid crystal panel is doubled. Moreover, the bias current flowing into the output amplifier incorporated in the gray-scale voltage production circuit 223 is reduced. In a liquid crystal control driver of the present embodiment, this control is extended based on the setting of a control register CTR by a timing control circuit 202 or the like.

Figure 9A:
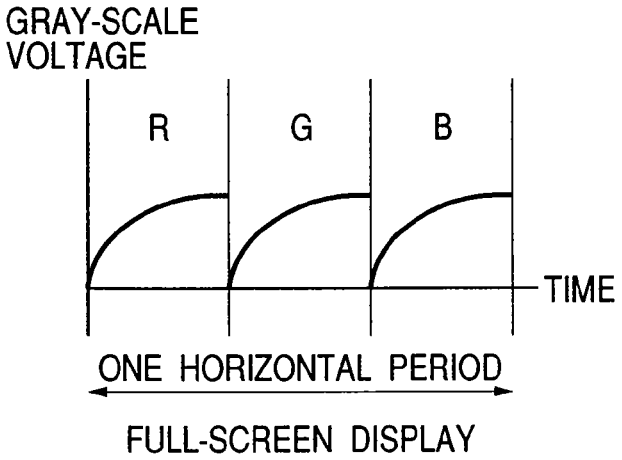
FIG. 9A and FIG. 9B show waveforms indicating that an action of charging a pixel location differs with a frame period needed by a system including the liquid crystal control driver of the second embodiment.
Figure 9B:
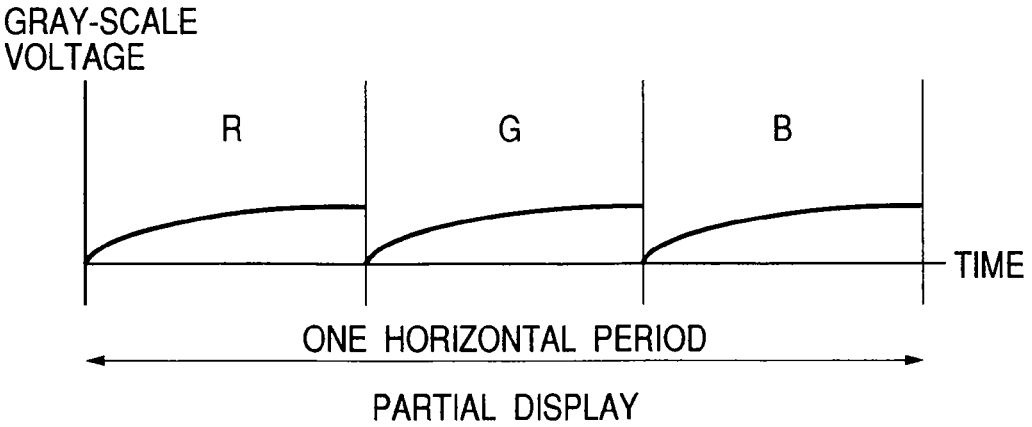

As mentioned above, when the frame frequency is halved, one horizontal period becomes, as seen from FIG. 9B, a double of the one for full screen display. On the other hand, since the timing control circuit 202 doubles the pulse duration of the red, green, and blue changeover control signals CLA, CLB, and CLC, even if a driving current that flows into the output amplifier incorporated in the gray-scale voltage production circuit 223 is halved, a pixel electrode can be fully charged. Since the driving current flowing into the output amplifier is halved, the power consumption of the chip can be reduced.

Preferably, displaying an image on the liquid crystal panel according to a frame period is controlled based on an internal oscillating clock OSC produced by an oscillatory circuit 201. Alternatively, the displaying may be controlled based on a clock DOTCLK applied to an external display interface 222. The internal oscillating clock OSC is set to a frequency of several hundreds of kilohertz. In contrast, the frequency of the dot clock DOTCLK generally ranges from several megahertz to several tens of megahertz.

Assume that a liquid crystal panel has a size which is defined with the number of pixels as 320 by 80 or with the number of dots as 320 by 240, and is driven with 16 lines left usable during a vertical-blanking interval. Moreover, image data representing 240 horizontal dots shall be displayed. By taking this case for instance, a description will be made of how the timing control circuit 202 shown in FIG. 6 determines the settings of a frequency division ratio setting register DRR, a one-horizontal period clock pulse count setting register CNR, and a charging time setting register TMR respectively. When the frame frequency is set to 90 Hz, one horizontal period 1H is calculated as 1H=1÷{90 [Hz]×(320+16) [lines]}=33.07 [μs]. The frequency of the oscillating clock OSC produced by the internal oscillating circuit 201 is 544 kHz (the cycle thereof is approximately 1.84 μs).

In this case, for example, 1 is set as a frequency division ratio in the frequency division ratio setting register DRR; 18 is set as the number of clocks in the one-horizontal period clock pulse count setting register CNR; and 6 is set in the charging time setting register TMR. Consequently, the charging time tc taken to charge each of red, green, and blue pixel electrodes is calculated as tc=1.84 [μs]×1 [frequency division ratio]×6 [clocks]=11.04 [μs].

On the other hand, when the frame frequency is set to 45 Hz, one horizontal period 1H is calculated as 1H=1÷{45 [Hz]×(320+16) [lines]}=66.14 [μs]. The frequency of the oscillating clock OSC produced by the internal oscillatory circuit 201 is 544 kHz (the cycle thereof is approximately 1.84 μs). In this case, for example, 2 is set as a frequency division ratio in the frequency division ratio setting register DRR; 18 is set as the number of clocks in the one-horizontal period clock pulse count setting register CNR; and 6 is set in the charging time setting register TMR. Consequently, the charging time tc taken to charge each of red, green, and blue pixel electrodes is calculated as tc=1.84 [μs]×2 [frequency division ratio]×6 [clocks]=22.08 [μs].

When the frame frequency is set to 45 Hz and the frequency of the oscillating clock OSC produced by the internal oscillatory circuit 201 is 544 kHz, for example, 1 is set as a frequency division ratio in the frequency division ratio setting register DRR; 36 is set as the number of clocks in the one-horizontal period clock pulse count setting register CNR; and 12 is set in the charting time setting register TMR. Consequently, the charging time tc taken to charge each of red, green, and blue pixel electrodes is calculated as tc=1.84 [μs]×1 [frequency division ratio]×12 [clocks]=22.08 [μs].

According to the timing control circuit included in the present embodiment, when the frame frequency is halved, the settings of the registers are modified. Thus, the charging time taken to charge a pixel electrode can be readily doubled. Moreover, a register in which the rising and dropping timings of a display control signal DISPTMG to be transmitted to the liquid crystal panel control can be set is included in order to enable the control of gate drivers associated with lines contained in non-display areas other than an area used for partial display. Herein, the gate drivers are controlled not to operate during partial display. In the liquid crystal panel, control is extended so that a gate driver associated with a source line to which the display control signal DISPTMG that is driven high is applied will be driven and a shift register will shift a bit during the high-level period of the display control signal DISPTMG. Consequently, power consumption is largely reduced.

Figure 10:
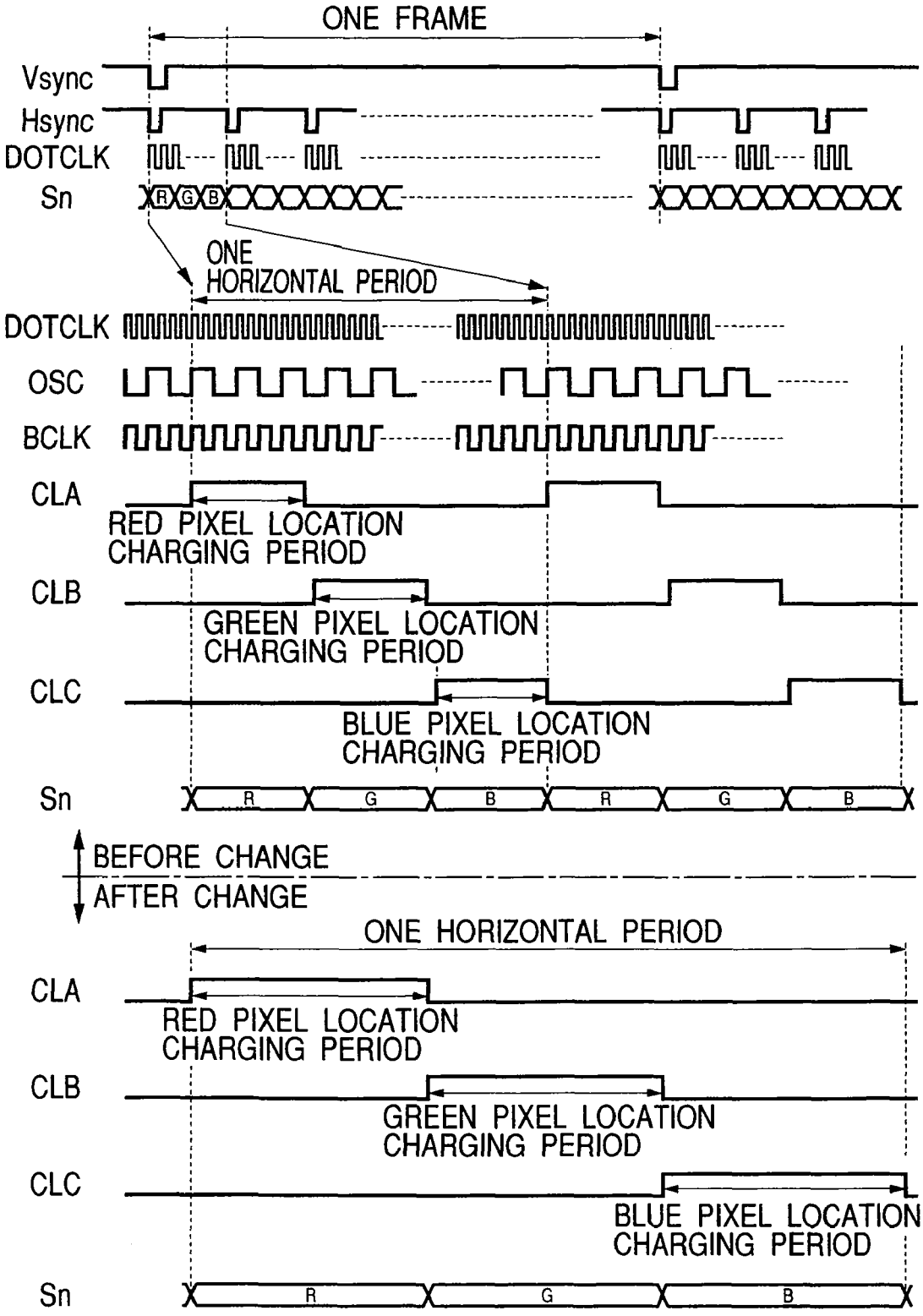
FIG. 10 is a timing chart indicating the timings of signals transferred in the display control driver of the embodiment before and after a charging time taken to charge a pixel electrode is varied by a timing control circuit.

FIG. 10 shows an example of the timings of signals attained before a charging time taken to charge a pixel electrode is changed by the timing control circuit included in the display control driver of the present embodiment and after it is doubled.

The present invention of the present applicant has been described in conjunction with the embodiments so far. The present invention is not limited to the embodiments. Needless to say, various modifications can be made within the gist of the invention.

For example, the embodiments have been described on the assumption that the gate drivers DRV1 to DRV320 are incorporated in the liquid crystal panel 100. The present invention can also be implemented in a case where the gate drivers DRV1 to DRV320 are formed as another semiconductor integrated circuit or a case where the gate drivers DRV1 to DRV320 are formed on the same chip as the liquid crystal control driver of each of the embodiments.

The invention made by the present inventor has been described in relation to a display device adapted to a cellular mobile telephone belonging to the field of utilization of the invention that is the background of the invention. The present invention is not limited to the display device adapted to the cellular mobile telephone. The present invention can be adapted to various types of portable electronic equipment including a personal handy phone (PHS) and PDA.

The advantages provided by the typical constituent features of the invention disclosed in the present application will be briefed below.

According to the present invention, one horizontal period is determined based on an image data size. A current flowing into a drive circuit that produces an image signal based on which each pixel location is charged is optimally controlled. Thus, a display control drive device requiring little power consumption and a display system employing the display control drive device can be realized. Moreover, in the display control drive device and portable electronic equipment including a display device such as a liquid crystal panel that is driven by the display control drive device, the exhaustion of a battery serving as a power supply can be suppressed. This results in portable electronic equipment that can operate for a prolonged period of time with one time of charging.

Furthermore, according to the present invention, even when a frame frequency is changed based on an image data size, a charging time taken to charge a pixel electrode can be optimized accordingly, and a current flowing into a drive circuit that produces an image signal is controlled optimally.

Consequently, a display control drive device requiring little power consumption and a display system can be realized.

What is claimed is:

1. A display control method to be implemented in a display control drive device that has a display memory in which display data is stored, and that reads display data sequentially from said display memory, produces primary color signals which are applied to pixel locations in a dot-matrix color display device, and transmits the primary color signals through a common terminal in a time-sharing manner, wherein a frame period that is a scanning period during which one screen image to be displayed on said display device is scanned is changed based on the size of an image to be displayed on said display device, and an output time taken to transmit each of said primary color signals is varied depending on the frame period, wherein when the image size is small, said frame period is made longer than it is when the image size is large, and said primary color signals are transmitted by taking a longer time, and wherein a signal production circuit controls a driving current flowing into an output amplifier according to the output time taken to transmit each of said primary color signals, so that when the output time is long, the driving current will be decreased, and when the output time is short, the driving current will be increased.

* * * * *